United States Patent [19]

Lamy et al.

[11] 4,126,011

[45] Nov. 21, 1978

[54] METHOD OF FABRICATION OF OFFSHORE STRUCTURES AND OFFSHORE STRUCTURES MADE ACCORDING TO THE METHOD

[75] Inventors: Jacques E. Lamy, Fontenay-aux-Roses; Dominique Michel, Paris; Francisco de Assis M. Serrano, Issy-les-Moulineaux, all of France

[73] Assignee: Compagnie Generale pour les Developpements Operationnels des Richesses sous-Marines "C.G. Doris", Paris, France

[21] Appl. No.: 797,839

[22] Filed: May 17, 1977

[30] Foreign Application Priority Data

| | | | |
|---|---|---|---|
| May 20, 1976 | [FR] | France | 76 15230 |
| Dec. 9, 1976 | [FR] | France | 76 37089 |
| Dec. 10, 1976 | [FR] | France | 76 37283 |

[51] Int. Cl.[2] ..... E02B 17/00; B63B 35/44

[52] U.S. Cl. ..... 405/196; 114/65 R; 405/200; 405/205

[58] Field of Search ..... 61/96, 97, 98, 94, 93, 61/86, 87, 88, 89, 90; 114/264, 265, 65 R; 175/7

[56] References Cited

U.S. PATENT DOCUMENTS

| | | | |
|---|---|---|---|
| 2,699,321 | 1/1955 | Nelson | 114/264 |
| 2,979,911 | 4/1961 | Sutton | 61/88 |
| 3,575,005 | 4/1971 | Sumner | 61/90 |
| 3,859,806 | 1/1975 | Guy et al. | 61/96 |
| 4,007,598 | 2/1977 | Tax | 61/97 |
| 4,012,917 | 3/1977 | Gendron | 61/96 |

*Primary Examiner*—Jacob Shapiro

*Attorney, Agent, or Firm*—Laurence R. Brown

[57] ABSTRACT

A method and apparatus for fabricating an offshore structure intended to be installed at sea comprising a support structure and a platform mounted on the structure. The platform is made up of one or more pieces that are floatable in water. The support structure is immersed to a depth sufficient for the portion thereof intended for the reception of the platform to be situated near the level of the latter. The platform is then fixed to the support structure which is then made lighter and brought to the place where it has to be installed.

37 Claims, 42 Drawing Figures

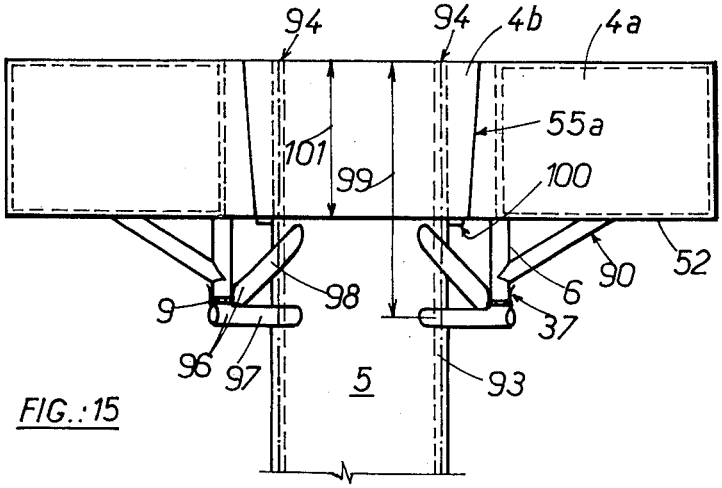
FIG.: 15
FIG.: 16
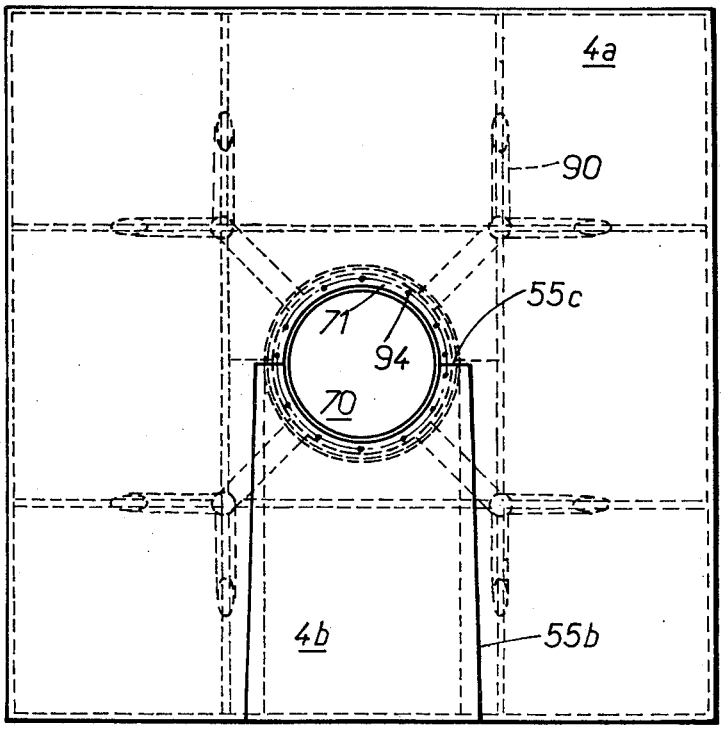

130
131
5

4
108
130
131
5

131
135
130
133
134
5

4
108
133
131
130
135
134
5

130

4
112
132
131
130
108
5

205
204
130

36
201
202
130
26
5

201
202
203
b
35
a
130
26
9
5

METHOD OF FABRICATION OF OFFSHORE STRUCTURES AND OFFSHORE STRUCTURES MADE ACCORDING TO THE METHOD

Offshore structures intended for the exploitation of under-water oil-bearing fields are always made up of a support structure (of concrete, steel or both) and of a bridge placed on this support structure. This bridge, also called platform, is intended to receive equipment for drilling and for the production of oil.

The method which is the object of the invention involves modifications of the support structure and of the shape of the platform, this structure and this platform being, of course, part of the invention.

According to the present invention there is provided a method of fabrication of an offshore structure intended to be installed at sea and comprising a support structure and a platform mounted on the said structure, in which the platform is made up of at least one floatable piece including the steps of immersing the support structure to a depth sufficient for the portion thereof intended for the reception of the platform to be situated near the level of the latter, fixing the platform to the support structure, making the offshore structure lighter and bringing it to the place where it has to be installed.

The invention also provides platform pieces for carrying out the method and an offshore structure made by the method.

With regard to the support structure, a distinction must be made between two cases:

structure with a single column or with two concentric columns, the exterior column being perforated;

structure with two or more columns, placed side by side.

The structure with a single column is built up till it reaches at least the level of the top of the platform.

The structure with two concentric columns is modified by the addition of a slab placed in the crown comprised between the two columns at a level slightly below the perforations. The interior column is built up to the depth of the platform.

The structure with two parallel columns is built up in the same way as that with a single column.

For parallel-columned structures with three or more columns, only two columns will be built up.

The platform will have two characteristics:

it is capable of floating;

it is composed of at least one floating piece but preferably by at least two separate floating pieces which will be assembled together after their positioning on the support structure.

Embodiments of the invention will now be described, by way of example, with reference to the accompanying drawings, in which:

FIGS. 15 and 16 show the view in elevation and the view in plan of a platform positioned on a structure with one single column;

Figures 34, 35, 36:
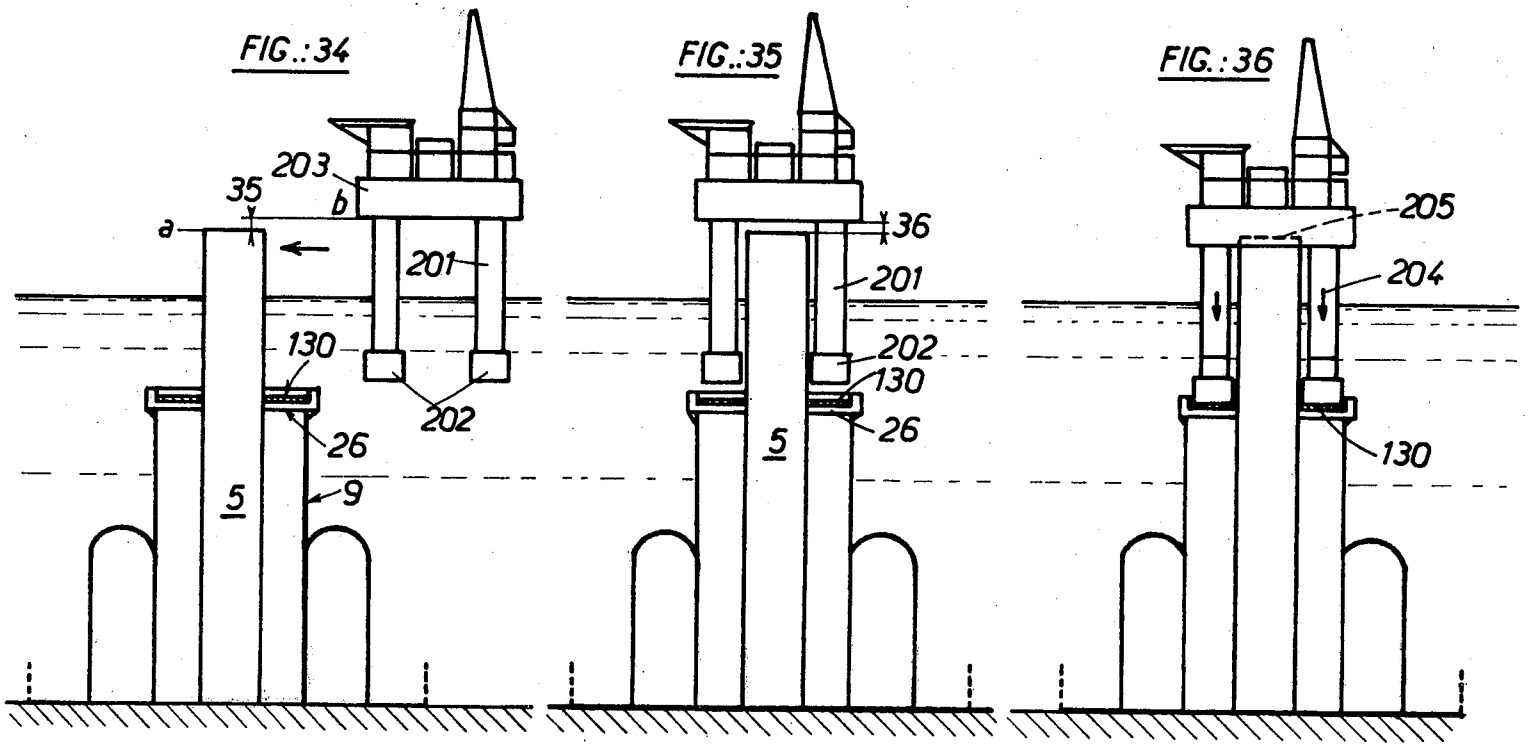

FIGS. 28 to 33*a* represent another embodiment according to the same method, whose mounting proceeds according to the same stages as the first example; and FIGS. 34 to 36 represent three essential stages of the putting into operation of another embodiment.

The platform 4 comprises two separate pieces 4*a* and 4*b*. These pieces have a water-tight caisson structure which allows them to float with the greater part or the totality of the pieces of oil drilling or oil production equipment 35 already installed.

Support legs for the platform 6 are already mounted on the platform.

With the platform afloat, there is a difference 36 in levels between the foot of these legs and the upper level of the centring cones 37 provided on the outer column 9 where the legs 6 will come to rest.

Figures 1, 1A, 1B, 2:
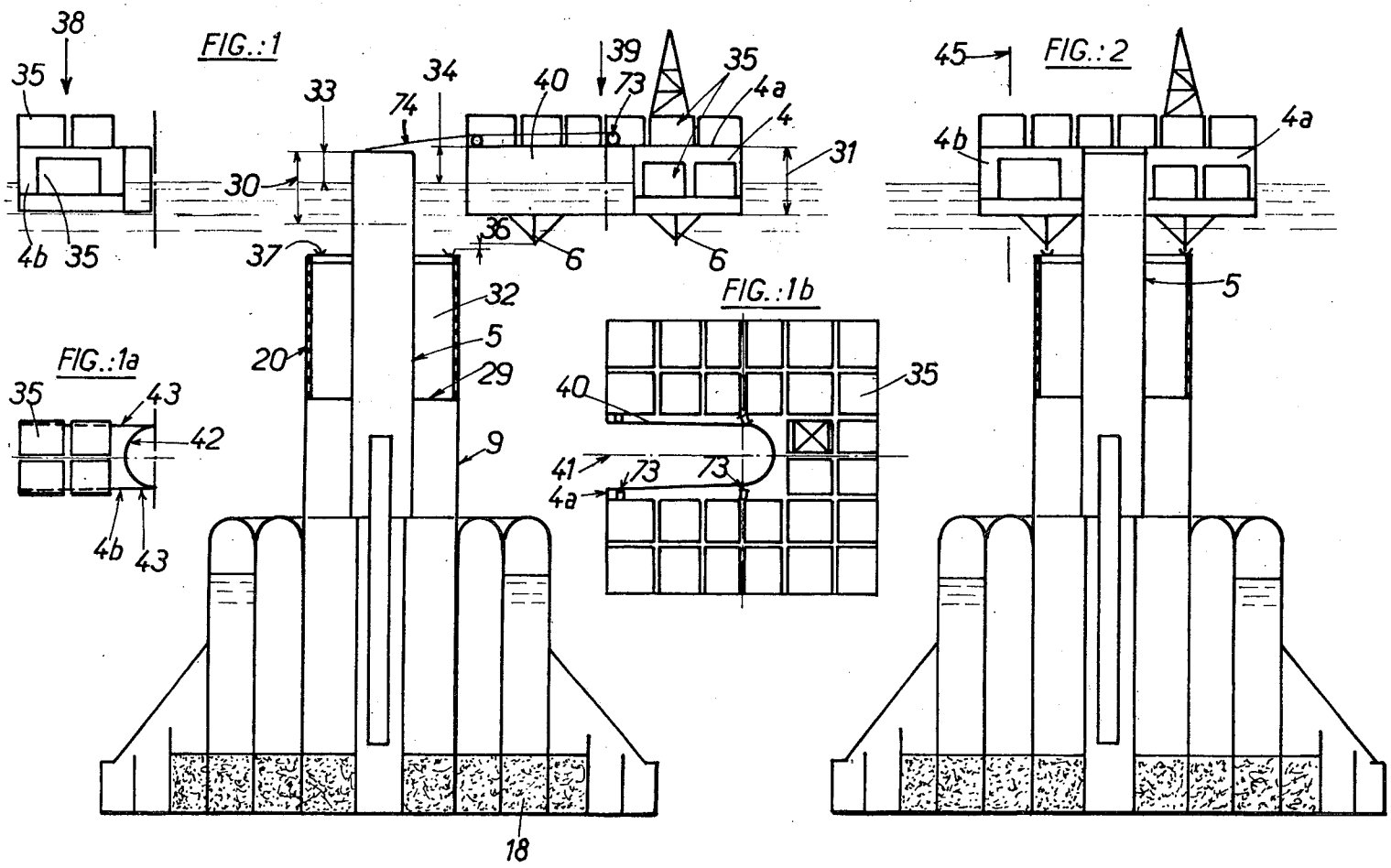
FIGS. 1 to 4 show diagrammatically in elevation a first method of assembly according to the invention.

FIGS. 1*a* and 1*b* represent respectively views in plan from 38 and 39 of the two platform pieces 4*a* and 4*b*.

The platform pieces 4*a* has a slot 40 whose central extremity is semi-circular to allow it to fit to the shape of the central column 5 with a certain play. Furthermore, the slot 40 widens out slightly at its outer-extremity 41 to facilitate entrance around the central column 5. The platform piece 4*b* has an exterior shape allowing it to fit at 42 on the central column and at 43 at the edges of the slot 40.

The positioning of the platform on the support structure is effected as shown in FIG. 2.

The platform piece 4*a* moves into contact with the central column 5, and then the platform 4*b* is brought up to close the slot 40.

Manoeuvring of the two pieces 4*a* and 4*b* is effected by means of winches 73 mounted on the piece 4*a* and cables 74 connecting these winches first to the column 5, and then, after positioning of the piece 4*a*, pulling the piece 4*b* up to its entrance into the piece 4*a*.

The two platform pieces comprise an assembly of abutments allowing them to be positioned together and to be centred in relation to the structure along with temporary arrangements for connection allowing the piece 4*b* to be made solid with the piece 4*a*. The description of these abutments and temporary arrangements for connection not represented in FIGS. 1 and 2 is to be found further on.

Figure 3:
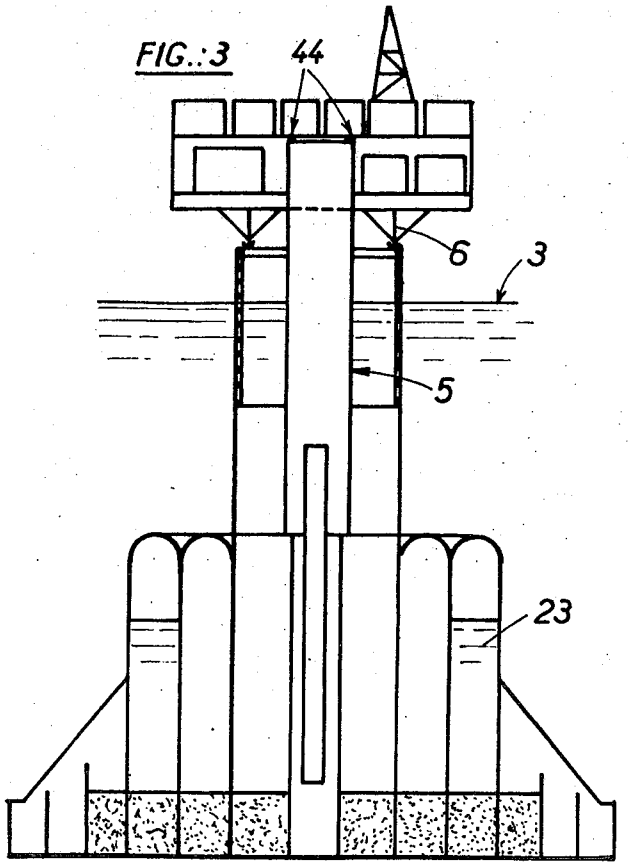

After centring of the platform on the support structure, some of the ballast-water 23 (FIG. 3) is pumped out of the support structure. The structure rises again, the legs 6 come to rest on supports provided at the base of the centring cones 37 and on the central column 5. FIG. 3 shows the platform at rest on the structure which has been partially deballasted and the platform being several meters above the surface 3 of the sea.

The permanent connection between the platform pieces 4*a* and 4*b*, by welding, bolting or other suitable means, is carried out in this position, just as is the fixing 44 of the platform on the central column 5.

Figure 4:
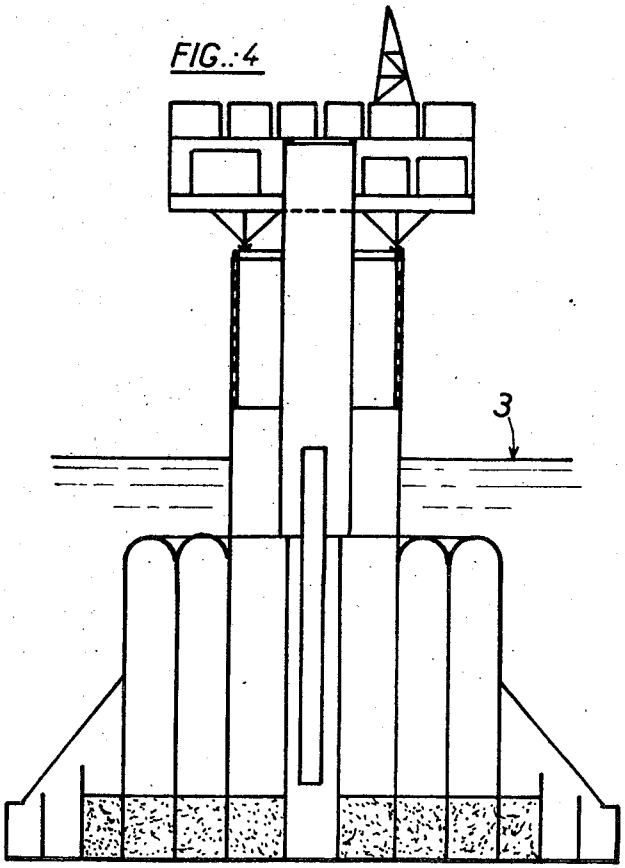

When these operations are finished, the ballast-water 23 is pumped out entirely; the structure rises again, and it is then entirely finished ready for towing as shown in FIG. 4.

First, as has already been said, the piece 4a is placed on the previously immersed structure, and then the closing piece 4b is brought to its location in the slot 41 of the piece 4a (see FIG. 1).

Figure 5:
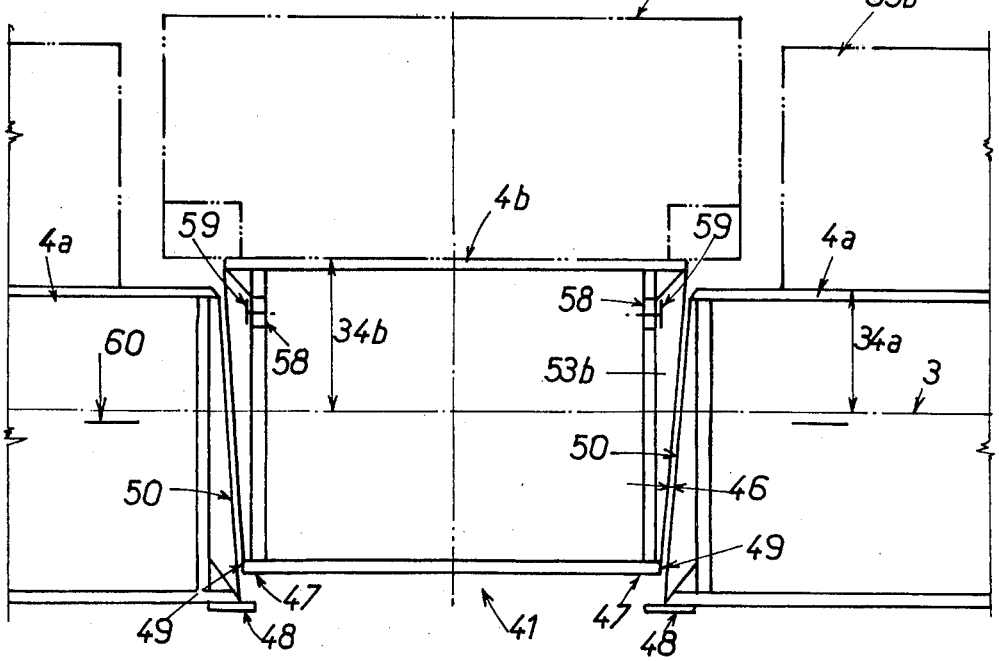
FIGS. 5 to 14 show the details of the arrangements for the centring and connection of the platformed composed of two units.

FIG. 5 shows the vertical section at 45 of FIG. 2. In this Figure, the introduction of the piece 4b into the slot 41 of the piece 4a can be seen. It will be noted that the height 34b of the piece 4b above its plane of flotation 3 (freeboard) is greater than that 34a of the piece 4a. Because of that, there is play 46 between the two pieces. When the piece 4b has arrived in its permanent location, the structure is slightly deballasted. The floating position changes from 3 to 3a in FIG. 6.

The extremities 47 come to rest on the supports 48, centring being ensured by the edge 49 sliding the length of the stay-plates 50. At the end of the process, the plates of the bridges 51a and 51b and the bottom-plates 52a and 52b are aligned and the stay-plates 53a and 53b are aligned and have a slight play 54.

The two pieces 4a and 4b are then made solid in a temporary way by means of connecting devices shown in FIGS. 9 to 12 which will be described later and the permanent connection between these pieces 4a and 4b is effected by welding or other suitable means.

Figure 6:
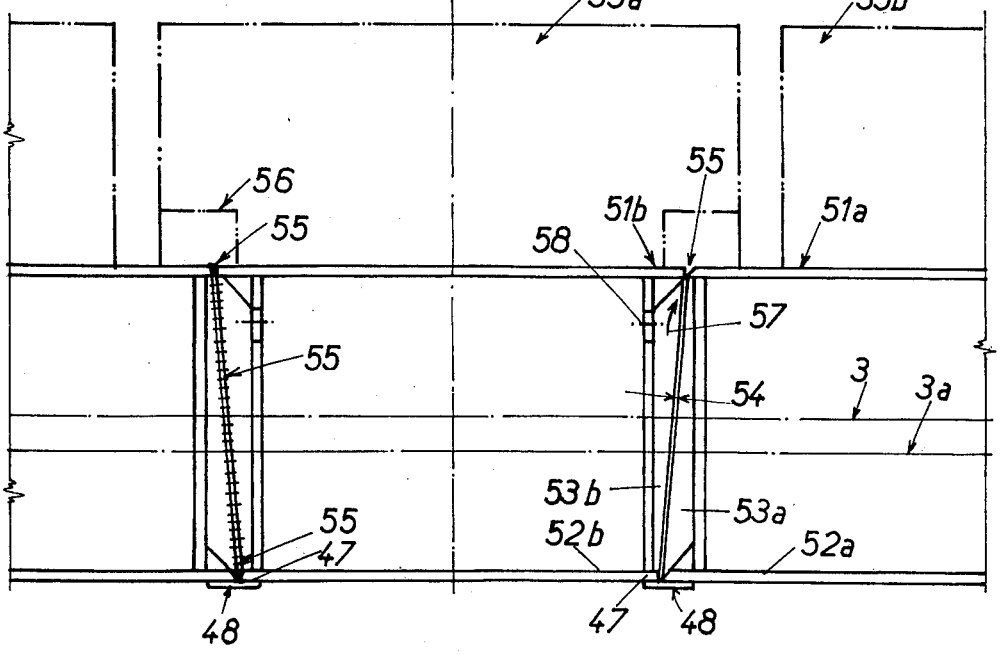

The welding operation is indicated by 55 in the left half of FIG. 6.

It is noted that the presence of the installations 35a and 35b on the platform does not hinder the positioning of the platform pieces 4b.

Passages 56 are provided on the pieces of equipment 35a to allow access to the welding region 55 between the plates 51a and 51b, but these passages can be avoided by welding the ceiling from the space 57 which will be accessible through the man-holes 58 comprising water-tight panels 59.

Figure 7:
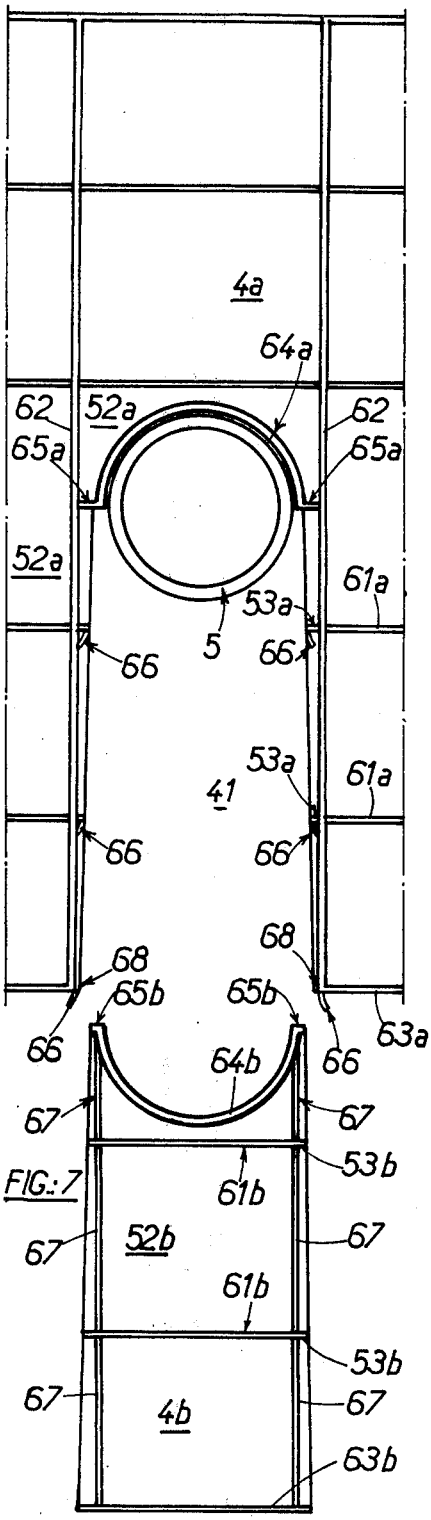
Figure 8:
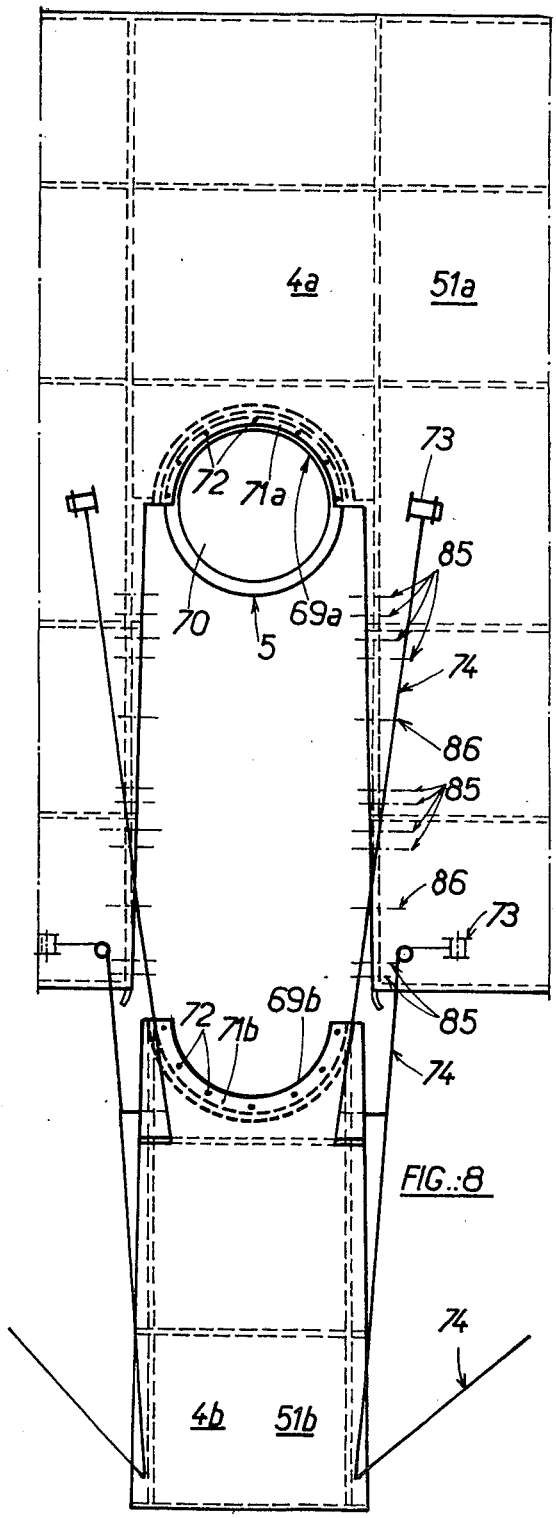

FIGS. 7 and 8 show the appearance of the platform piece 4b facing the slot of the piece 4a.

FIG. 7 is a section at 60 of FIG. 5. FIG. 8 is a view from above of this same FIG. 5.

FIG. 7 shows the construction of the pieces 4a and 4b of the platform. The piece 4a has already been placed on the support structure and it is centered on the column 5. Here are to be found transverse bulkheads 61a, longitudinal bulkheads 62, plate 63a and the half of the plate 64a of the central well connected to the longitudinal bulkheads 62 by the flanges 65a. The whole of the periphery of the slot 41 is water-tight as well as the connection with the bottom 52a. The stay-plates 53a are placed in the extension of the bulkheads 61a and have centring tabs 66 as do the extremities of the plate 63 to prevent all unwanted catching of the pieces 4b during introduction into the slot.

The piece 4b comprises the second half of the plate 64b of the central well, with two flanges 65b which will come to rest on the flanges 65a, to which plates for temporary water-tightness 67, which extend the length of the unit 4b, will be welded.

These plates are interrupted at right angles by the transverse bulkheads 61b which project beyond the plates 67 to form the stay-plates 53b (see also FIGS. 6 and 7) and which allow, after positioning of the piece 4b in the slot 41, the establishing of the mechanical continuity of the bulkheads 61a and 61b by welding (55 in FIG. 6). The end-plate 63b itself also projects to allow welding on the extremity 68 of the plate 63a of the piece 4a, thus establishing the continuity of this mechanical unit.

In FIG. 8, all the constructional units described in FIG. 7 are in dotted lines. These units are covered in water-tight fashion by the platform plate 51a on the piece 4a which form the floor of the platform and which is soldered onto the assembly of bulkheads and plates.

The platform-plates 51a and 51b each have a semi-circular opening 69a and 69b which will give free access to the interior 70 of the column 5. The peripheries 71a and 71b constitute a flange which comprises passage-holes 72 for fixing the platform on top of the column 5 by means of prestressing cables taken within the thickness of the wall of the column 5. This fixing with cables is in current use and allows transmission of the considerable swell forces which exist in this region.

The introduction of the piece 4a into the slot in the piece 4b is made, as has already been shown in FIG. 1, by means of winches 73 and cables 74 as shown in FIG. 8.

FIGS. 9 to 12 show a preferred way of providing a temporary connection between the pieces 4a and 4b.

Figure 9:
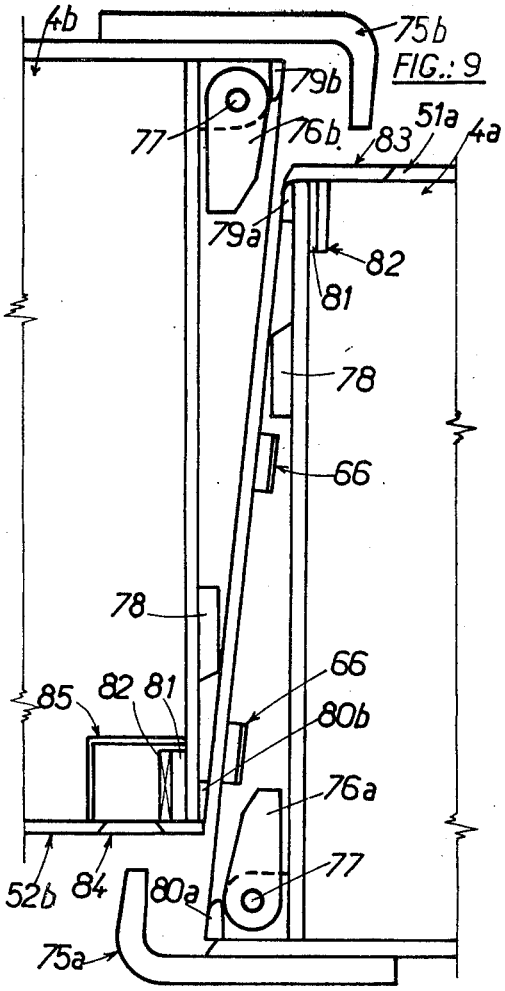
Figure 11:
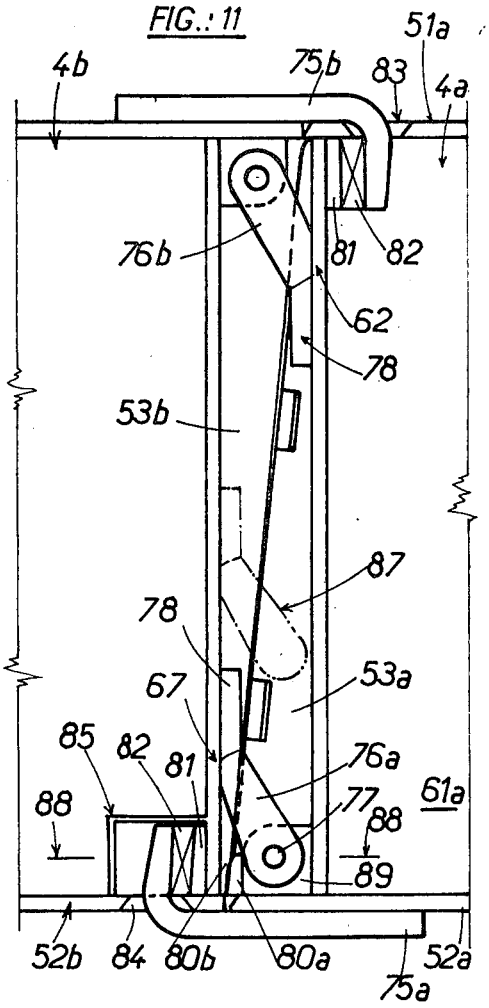

FIGS. 9 and 11 give the detail of the right side of FIGS. 5 and 6.

In FIG. 9, the hooks 75a and 75b are to be seen fixed respectively on the platform pieces 4a and 4b, the retractable catches 76a and 76b turning about axes 77, the abutments for shear forces 78, the lateral abutments 79a, b, and 80a, b, the centring-tabs 66, the support-blocks 81 and the flat jacks which are in retracted position 82, and the openings 83 and 84 on the platform-plates 51a and 51b. A casing 85 ensures water-tightness around and above the lower openings 84.

FIG. 11 shows the temporary connecting devices in operation. The platform piece 4b has been introduced from below into the slot 41 of the platform piece 4a, as has already been said, the structure has then been deballasted and the piece 4b has been displaced downwards to come into place in the position shown in FIG. 6. The hooks 75a and 75b are put into the holes 83 and 84 whose edges are inclined to facilitate centring, the flat jacks 81 and 82 are then inflated and the catches 76a and 76b, controlled by hydraulic jacks (not shown) are turned to come to rest on the abutments 78 and on the bulkheads 62 and 67.

There can be any number of connecting devices with hooks with their jacks and abutments and they can be disposed in the neighbourhood of the transverse bulkheads 61 as shown in FIG. 8 where four hooks for each bulkhead 61a are represented at right angles chain-dotted 85 and two hooks near the plate 63 and two other hooks 86 between the bulkheads, it being understood that there can be altogether any number of hooks.

The abutment-devices constituted by the catches 76 can be four in number situated on either side of each bulkhead as in FIG. 11, but their number can be increased by placing them as indicated by 87 in FIG. 11. When all these devices are in operation, they can transmit very considerable moments and shear forces (for example ten thousand meters tonne per hook, and a thousand tonnes per catch).

Figure 10:
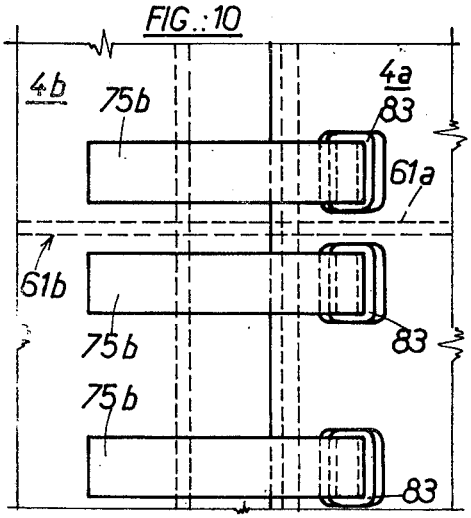

FIG. 10 is a view from above of FIG. 9 where there is to be seen three of the four upper hooks 75b solid with the piece 4b and the openings 83 cut in the piece 4a.

Figure 12:
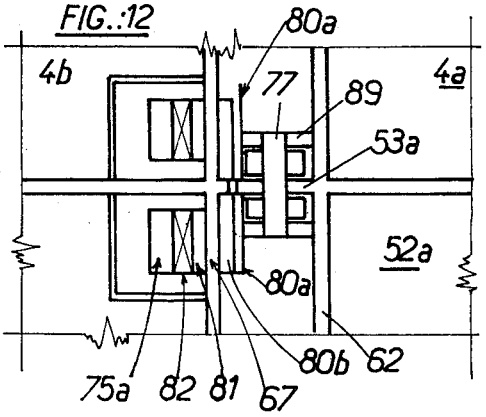

FIG. 12 shows a section at 88 in FIG. 11 where there are to be found the various elements constituting a temporary connection, that is to say the hooks 75a held by the flat jacks 82 already pumped up resting on the blocks 81 fixed to the plate for temporary water-tightness 67 and the catches 76*a* turning on the axis 77 passing through the stay-plate 53*a* and the lugs 89 solid with the longitudinal bulkhead 62 of the bottom-plate 52*a* and abutments 80*a*, themselves solid with the bottom-plate 52*a* and the stay-plate 53*a*.

The pressure on the rear face of the flat jack is completely taken up again because it passes directly (through the block 81, the plate 67, the abutment 80*b*, the abutment 80*a*, the lugs 89 co-operating with the stay-plate 53*a* and the plate 62) to the lower part of the transverse bulkhead 61*a* and to the bottom-plate 52*a* which is in its vicinity.

Figure 13:
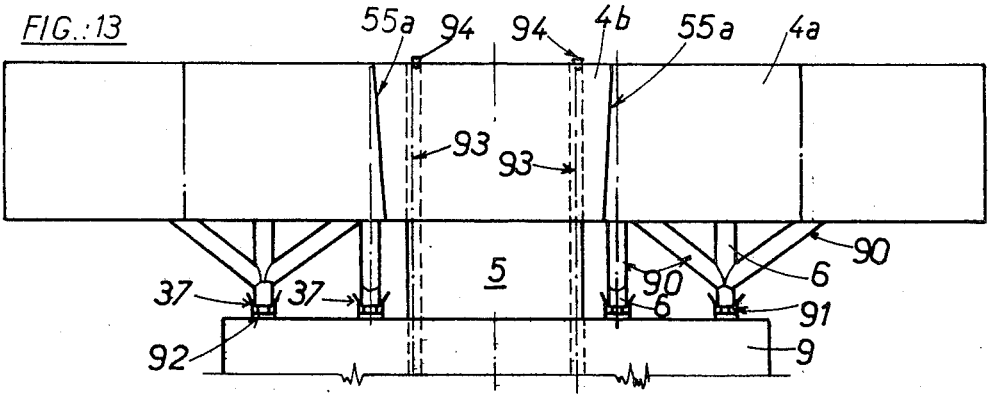
Figure 14:
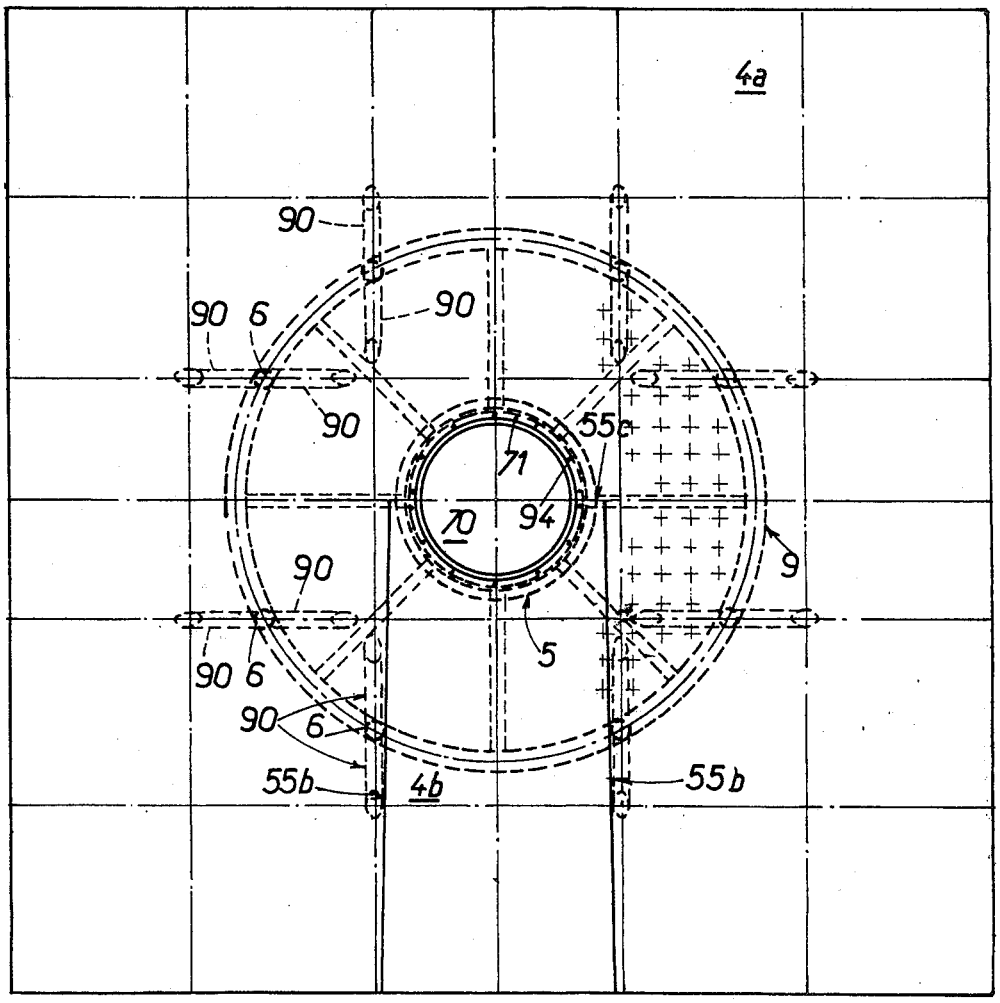

Views of the whole of the platform, after assembly, and resting on the support structure, are shown in FIGS. 13 and 14 where, for easy understanding, the pieces of equipment mounted on the platform are not shown.

FIG. 13 shows a view in elevation of the platform. The platform pieces 4*a* and 4*b* are shown here. The support legs 6 with their windbracings 90, rest on top of the column 9 through the intermediary of a cushion of neoprene rubber 91 on the base 92 of the centring cones 37 which is fixed on the upper face of the column 9 by anchorage rods (not shown). In the figure, it is to be noted that the assembly of legs is solid with the platform piece 4*a* and that the platform piece 4*b* does not require a leg because it is solid solely with the piece 4*a* and with the central column 5 as will be described below.

The connection between the platform pieces 4*a* and 4*b* is made by welding along the length of the line 55*a*.

FIG. 14 is a view in plan of the platform after assembly. The legs 6 are to be seen resting above the column 9 with their windbracings 90, the assembly of the pieces 6 and 90 being fixed solely to the platform piece 4*a*.

There is also to be found here the fixing of the platform piece 4*b* to the unit 4*a* executed by welding the length of the lines 55*b* and 55*c* and the fixing of it on the central column 5 by means of the flange 71 (constituted by the half-flanges 71*a* and 71*b* of FIG. 8 assembled by welding) by the prestressing cables 93 (FIG. 13) whose ends are secured by the anchorages 94. The interior space 70 of the column 5 is entirely open.

The arrangement of the platform and the assembly procedure which we have just described has been on the model of a support structure with two concentric columns, but this platform arrangement and this procedure are prefectly applicable to support structures comprising either a single or several columns.

In FIGS. 15 and 16, there is to be found the same constructional elements as in FIGS. 13 and 14, marked with reference marks in the same way, but the support of the legs 6 is realized by means of inverted brackets 96 solid with the column 5. These brackets are composed of a transverse bar 97 supported by a diagonal 98, the connection between the two being ensured by the centring cones 37 at the bottom of which is the base 92 of the cones which will directly support the foot of the leg 6.

The cushions of neoprene rubber 91 in FIG. 13 are omitted because, after the positioning of the platform, the centring cones 37 will be lifted and the foot of the column 6 will be welded directly to the base 92. The bracket 96, the leg 6 and its windbracing 90 will constitute a single trellis which will ensure an effective fixing for the platform above the column 5, the very great height 99 of the unitary assembly thus formed giving a considerable inertia.

Here it must be noted that in cases where the platform is of small dimension (a platform whose side is for example about three times less than the diameter of the column 5), the legs 6 and the brackets 96 can be omitted. The fixing of the platform on the column 5 will be made then by means of a flange 100 solid with the column 5 on which the bottom-plate 52 is fixed by welding. The casing of the platform on the column will then have a height 101.

Figure 17:
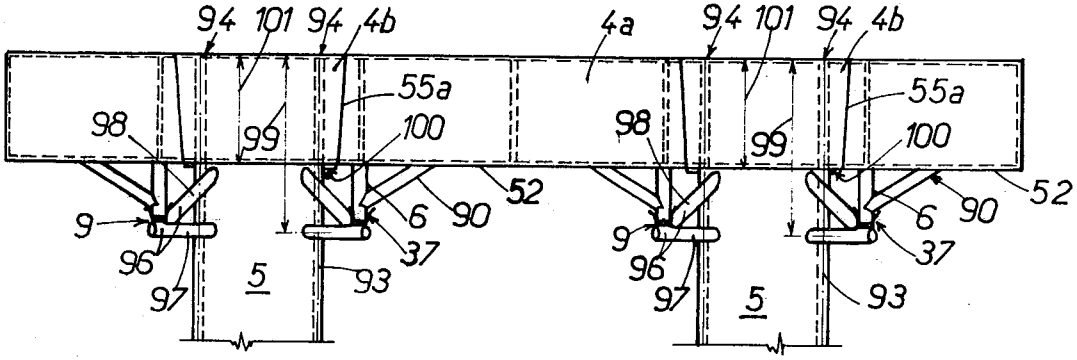
FIGS. 17 and 18 show the view in elevation and the view in plan of a platform positioned on a structure with two columns.
Figure 18:
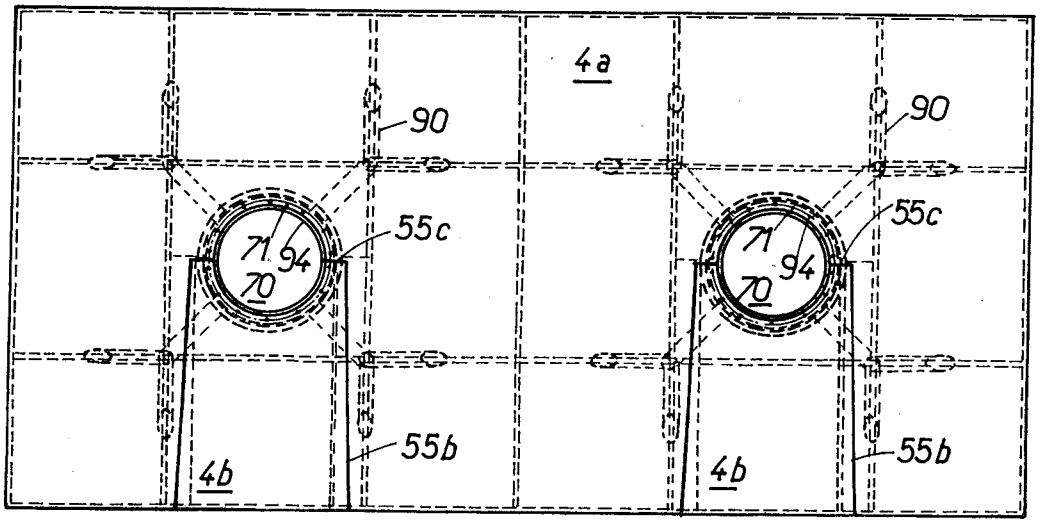

The piece 4*a* shown in FIGS. 17 and 18 possesses two slots where two pieces 4*b* will come to lodge; the rest of the positioning on the columns 5 and the assembly being identical to the preceding situation. It will be noted that the system of legs 6 is always solid solely with the piece 4*a*.

In the situation where the platform is of small dimension, the platform will be fixed on the columns by means of flanges 100 as already conveyed for FIG. 15.

Figure 19:
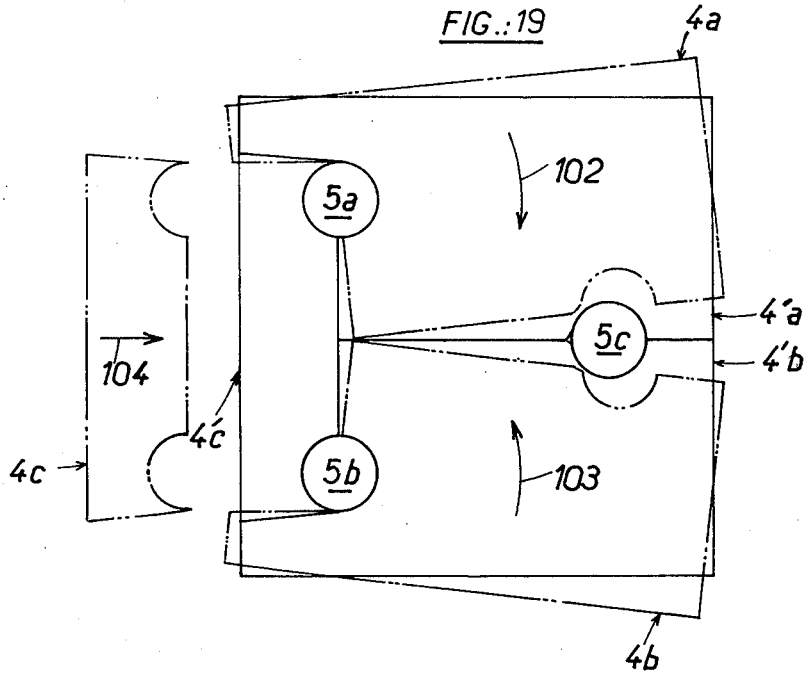
FIG. 19 shows the view in plan of a platform positioned on a structure with three columns.

In the case of support structures with three or more parallel columns, the arrangement adopted is shown diagrammatically in FIGS. 19 for the structure with three columns and 20 for the structure with four columns.

In FIG. 19, there are to be found the three columns 5*a*, 5*b* 5*c*.

The platform pieces represented chain-dotted 4*a*, 4*b* 4*c* are positioned in this order. It is noted that, for their positioning, the pieces 4*a* and 4*b* are brought onto the columns 5*a* and 5*b* and then pivoted in the direction of the arrows 102 and 103 to abutment on the column 5*c*. The piece 4*c* is then positioned by moving it in the direction of the arrow 104. When they are assembled, they occupy the positions 4'*a*, 4'*b*, 4'*c*.

Figure 20:
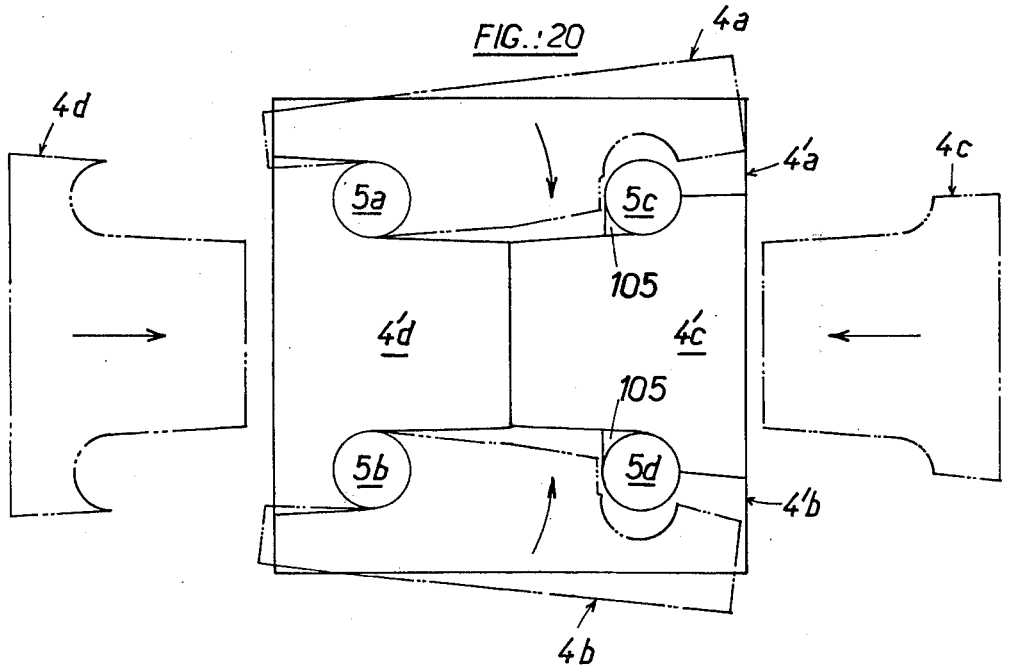
FIG. 20 shows the view in plan of a platform positioned on a structure with four columns.

In FIG. 20, there are to be found the pieces 4*a*, 4*b* which are brought to abutment on the columns 5*a* and 5*b* and then turn around these columns to rest on the columns 5*c* and 5*d*.

The pieces 4*c* and 4*d* are then positioned in this order. The empty spaces 105 are filled by means of further pieces put in place after assembly of the pieces in the position 4'*a*, 4'*b*, 4'*c*, 4'*d*.

Figure 21:
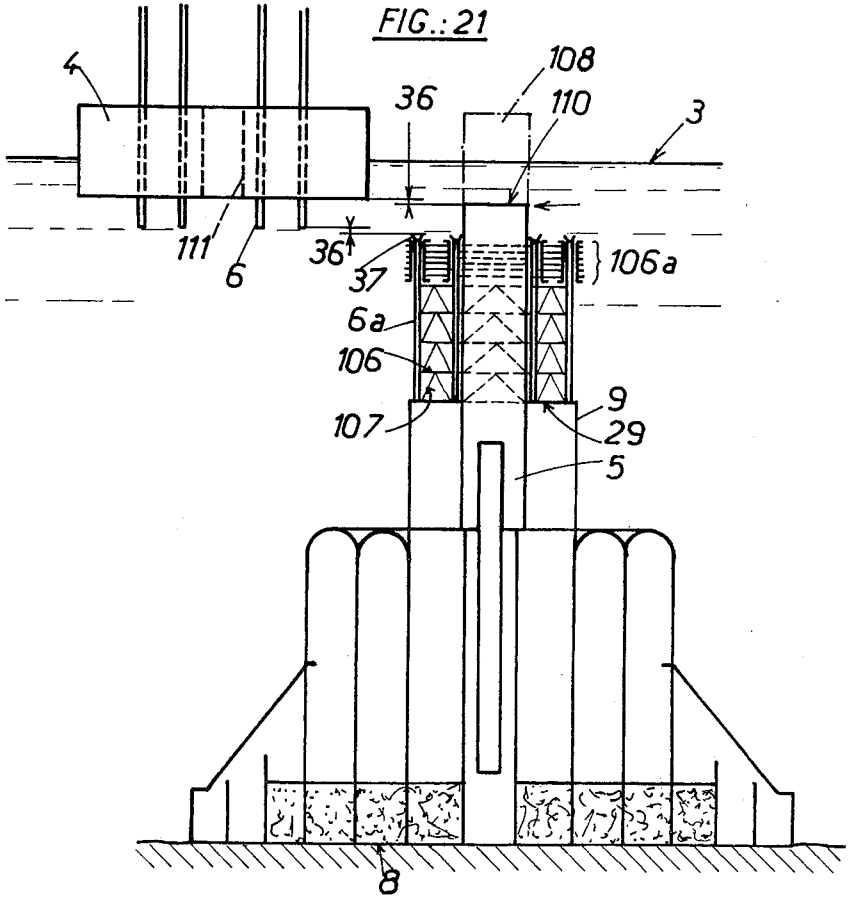
FIGS. 21 to 25 show diagrammatically in elevation a method of positioning of a platform on two concentric columns.

Another interesting possibility is shown in FIG. 21. This variant concerns support structures with two concentric columns and allows omission of the whole of the upper part of the column 9 situated above the slab 29 of FIG. 1.

In this variant, the legs 6 of the platform are telescopic and controlled by existing arrangements of racks or of jacks.

Cross-bars 106 fixing the legs 6 together solidly and connecting the legs 6 to the central column 5 can be mounted after the platform is put in its permanent position on the support structure.

This method can moreover be used in different ways.

Thus, as a preliminary, the support structure can be placed on the bottom of the sea 8, in its permanent location or on an intermediate site with approximately identical depth.

FIG. 21 represents a platform-weight with two concentric columns comprising the columns 6*a* fixed rigidly approximately at the intersection of the slab 29 and the exterior column 9 of the support structure. Control of the immersion of the structure is effected thanks to the central column 5 which always projects beyond the level of the water until the structure is placed on the marine bottom.

The legs 6a can be connected together by cross-bars 106 and, should it be required, a trellis 107 giving them a great rigidity.

On the upper part of the legs 6a, there are to be found several cross-bars 106a which are stacked one on top of the other and which can slide the length of the legs 6a.

The legs 6a are terminated at the top by centring arrangements 37 as described above (FIG. 1).

In other respects, the upper extremity of the column 5 projecting beyond the surface of the water 3 can comprise a de-mountable part 108.

FIG. 21 again shows the platform 4, like that which has been described above, ready to be placed on the structure whose upper part is the subject of FIG. 21b. It will be noted that the telescopic legs 6 of the platform are on such a level that they can pass with a certain play 36 above the centring arrangements 37 provided above the legs 6a of the support structures.

Figure 21A:
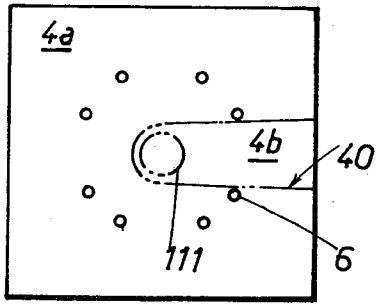

FIG. 21a shows the view in plan with the slot 40 and the legs 6, as has been described above.

The positioning of the platform on the structure can be done in two different ways:

either with the platform in two pieces 4a, 4b which are to be placed around the part of the column 5 which projects beyond the water, or by de-mounting the extremith 108 of the column 5.

Only this second solution will be described here because the first has been described above.

In this situation, the piece 108, which is a water-tight, floatable assembly, is first ballasted, then disconnected from the column 5 and then deballasted until it is afloat. The upper end 109 of the column 5 has been sealed as a preliminary by a temporary water-tight plate 110. With this solution, it is no longer necessary to divide the platform into two pieces 4a and 4b. The bridge 4 can therefore be in a single piece and comprise a central well 111, water-tight at its foot, which will give access to the column 5 after positioning.

The play 36 also exists between the bottom of the body of the platform and the top 109 of the column 5 (FIG. 21).

FIGS. 22 to 25 show the successive stages of the positioning of the platform on the structure.

The trellis 107 has not been shown for reasons of simplicity.

Figures 22, 23, 24, 25, 26, 27:
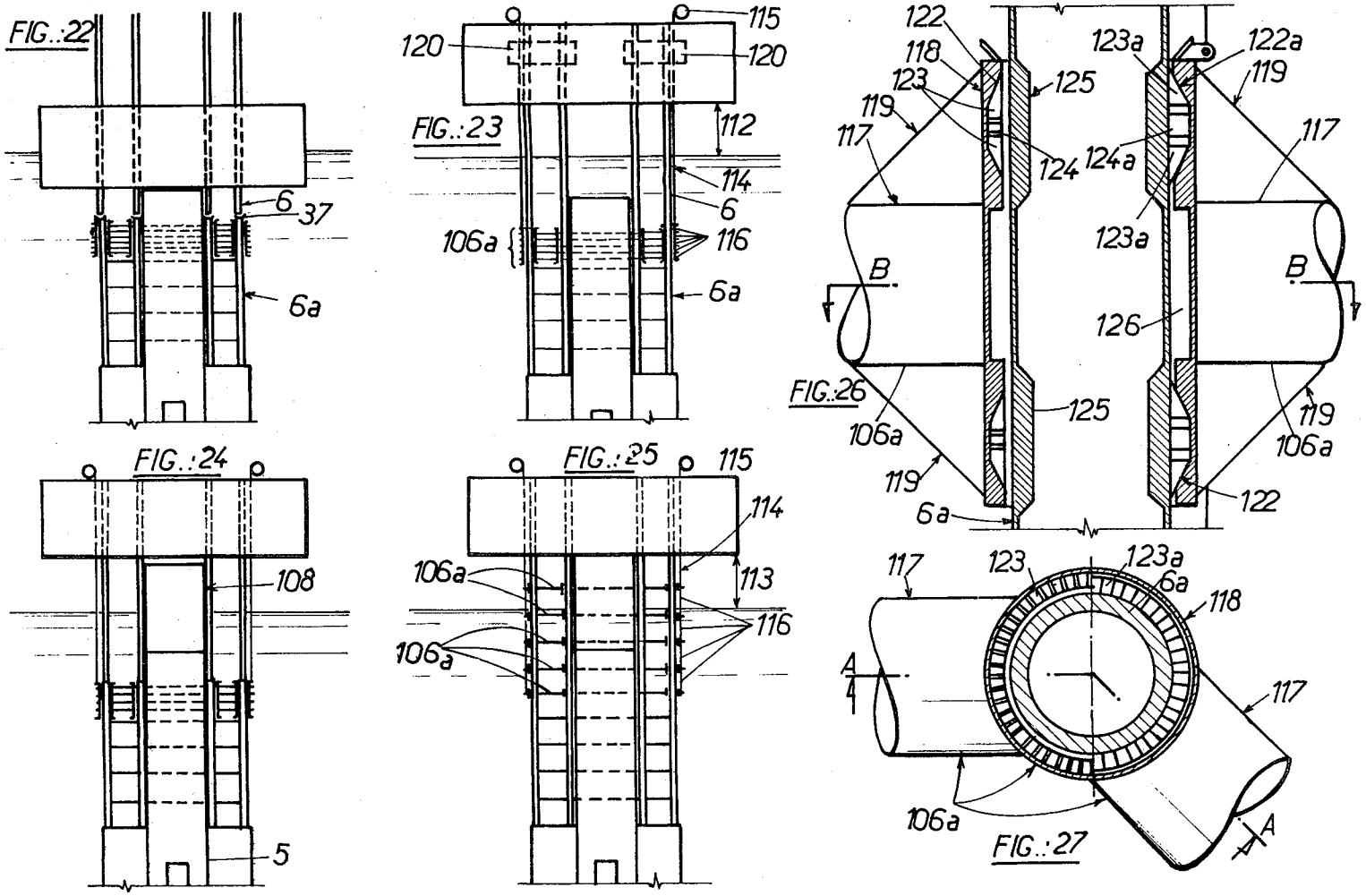
FIG. 26 is a vertical section of the intersection between a cross-bar and a column, at A—A of FIG. 25.
FIG. 27 is a transverse section at B—B of FIG. 26.
Figure 30:
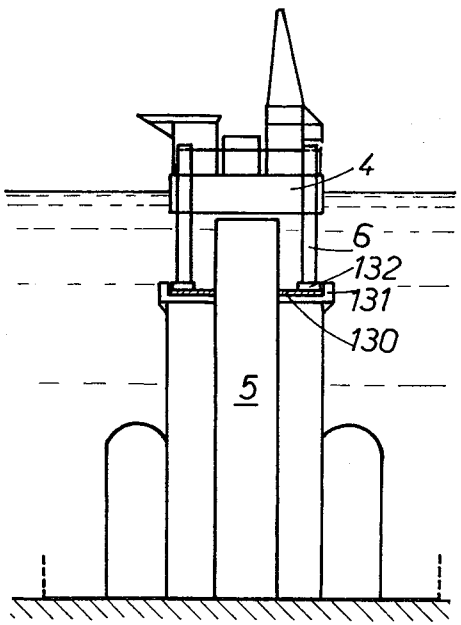
Figure 29:
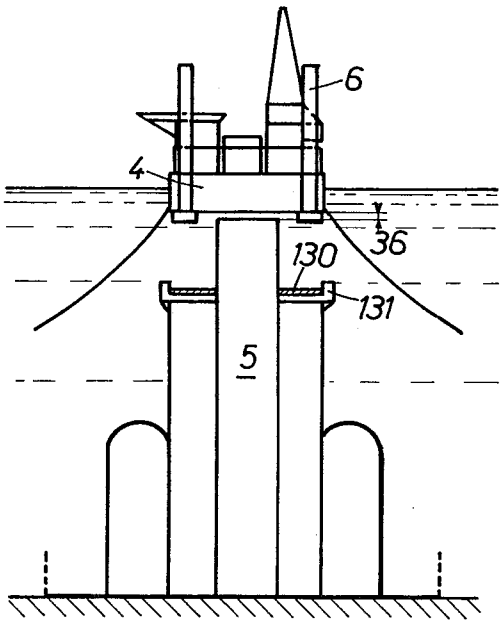
Figure 28:
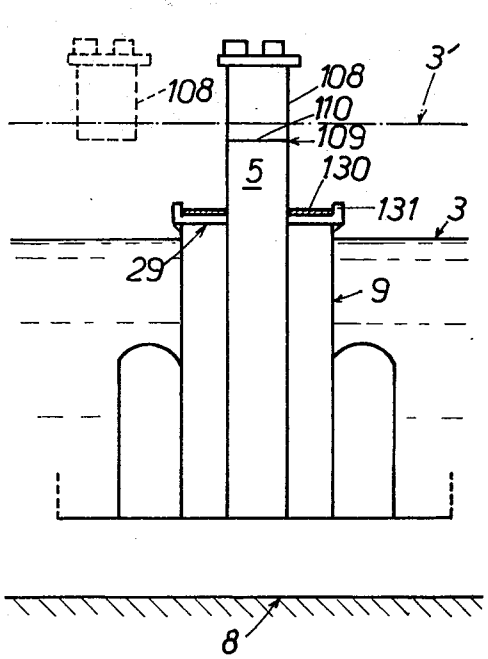
Figures 31, 31A, 32, 32A, 33, 33A:
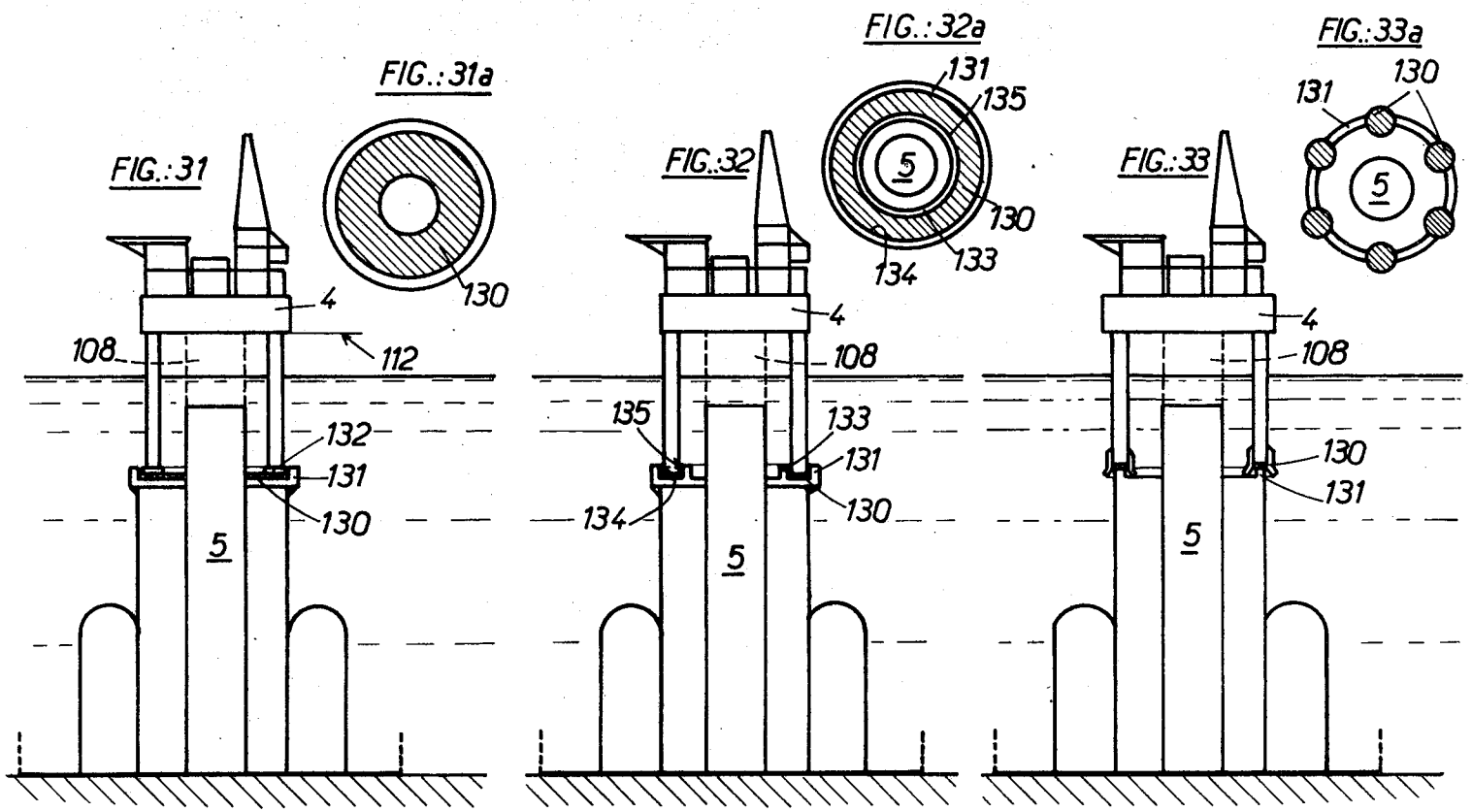

In FIG. 22, the platform 4 has been slid above the structure. The legs 6 present themselves in the centring cones 37 of the legs 6a.

In FIG. 23, the lower extremities of the legs 6 centred by the cones 37 have come to rest on the upper extremities of the legs 6a. Arrangements for lifting by rack or jack 120 provided on the platform and acting on the legs 6, are put into operation; the platform rises above the water to a height 112 slightly greater than the permanent height. The cables 114, coming from the winches with which the platform is equipped, are fixed by divers to the sliding cross-bars 106a which are alredy connected together by cables 116. The cables 114 pass through water-tight passage wells (not shown) in the platform.

FIG. 24 shows the positioning of the piece 108 which is to slide between the platform and the top of the column 5. After positioning, this piece is ballasted and comes to rest on the top of the column 5 to which it is connected by a mechanical arrangement (for example bolted flange or prestressing cables, if the piece 108 is of concrete) not represented.

The platform is then lowered and then fixed onto the top of the piece 108 as shown in FIG. 25. The temporary bulkhead 110 and, if required, the bottom of the well 11 are then de-mounted to allow free passage between the platform and the interior of the column 5. Finally, as shown in the same FIG. 25, the cables 114 are tightened by the winches 115 and lift the cross-bars 106a into their permanent position, the cables 116 becoming taut one after the other, thus keeping the spacings of the cross-bars 106a at a predetermined value up to the moment when these cross-bars 106a are made solid with the legs 6a by means of a fixing arrangement incorporated with the cross-bars or the legs.

FIGS. 26 and 27 show a preferred way of realisation of such an arrangement. In these Figures, there is shown one of the cross-bars 106a constituted by tubes 117 solid with a sleeve 118 which is able to slide the length of the leg 6a. The connection between the tubes 117 and the sliding sleeve 118 can be reinforced by means of stay-pieces 119. Between the sleeve 118 and the leg 6a are placed two connection-arrangements 122.

In the left half of FIGS. 26 and 27, the connection-arrangements 122 have been drawn in the ready position, that is to say, open. In the right half of the same Figures, the arrangements are in closed position and ensure the fixing of the sliding sleeve 118 to the leg 6a.

Each connection-arrangement 122 is made up of two assemblies of wedges 123 disposed in a circle (FIG. 27) and buttressed one against the other. The space between the wedges is maintained for example by means of springs, (not shown). The ends of the wedges are flat and come to rest on an assembly of annular flat jacks 124 (four flat jacks superposed in FIG. 26).

When the cross-bars 106a are in their permanent place, the flat jacks 124 are pumped up (with a concrete filling, for example). They then take the form 124a (in the right half of FIG. 26) and push back the crown of wedges which take up the position 122a (in this same right half of FIG. 26) and prevent all relative movement between the sliding sleeve 118 and the column 6a. In the right half of FIG. 27 the wedges are to be seen in this new position 123a.

To the right of the connection-arrangements 122, on the legs 6a, reinforcements 125 have been provided to offer resistance to the large radial stresses caused by these arrangements.

After clamping, a filling of cement or resin can be injected into the space 126 to complete immobilisation and avoid corrosion.

Positioning such as has just been described comprises an operation which could pose a problem, most of all on the open sea. It concerns centring of the movable legs 6 on the legs 6a, a delicate operation because of the diameter of these units which, in relation to the central column, is greatly reduced; these legs are consequently also more fragile and withstand the centring manoeuvres less well.

To avoid all accident of this kind, the legs 6a (immersed) can be omitted and the movable legs 6 can be extended by nearly equal length.

These lengthened legs 6 can come down to the level of the slab 29 which rests on one side on the wall 9 and on the other on the exterior wall of the central shaft, and can rest directly on the latter, as can be seen in FIGS. 28 to 33a. In this case, it is advisable to provide a circular shock-absorption arrangement 130.

To facilitate simultaneous centring of the whole floating assembly, the slab 29 can be surrounded by an exterior ledge 131.

When the feet of the legs 6 are supplied with enlarged feet which come to rest on the slab 29, this centring by the ledge 131 can be sufficient when tolerances are taken into consideration. If these feet 132 do not exist, it can be advisable to provide a second flange 133 on the slab 29, which is concentric with and within the ledge 131, their two opposite faces 134 and 135 being capable of being slightly widened towards the top (not represented) to facilitate the introduction of the legs 6 and their centring.

Finally, the legs 6 could be placed on the ledge 131, which can moreover be discontinuous.

Another way of connecting the support and the platform will be described in the three last FIGS. 34 to 36.

As FIG. 34 shows, the support is placed on the bottom 8 of the sea and the central shaft 5, in one single piece, distinctly projects beyond sea-level 3 up to the height on which the bottom of the platform will be placed. The essential innovation of this embodiment is constituted by the legs 201 which come down from the platform 202 and end in enlarged feet 203; the legs are hollow, which allows them to be ballasted and deballasted at will, raising the bottom of the platform to the desired height. Thus, during transport to the site of the yard, these legs can be ballasted, to lower the centre of gravity, and deballasted at the approach to the site.

In FIG. 34, the upper level of the shaft reaches the height *a*, so that the buoyancy of the platform must be such that its bottom can reach a slightly higher level *b*, the distance 36 between *a* and *b*, by analogy with the examples previously developed, can be relatively small and will be principally a function of the swell at the spot where the offshore structure will be placed.

When the central shaft 5 is well enclosed by the legs 201, one stops the translation of the platform 202, which, as is clearly visible in FIG. 35, always presents a vertical distance 36 between the top of the central shaft 5 and the bottom of the platform 202.

At this moment, water is allowed to enter into the hollow legs which begin to descend, as the arrows 204 of FIG. 36 indicate, up to the moment when the bases of the legs touch the slab 29 which connects the exterior column 9 to the exterior wall of the shaft 5, this slab being coverable with a shock-absorption system 130, as has been explained in greater detail above.

Should it be required, the height of the hollow legs can be less than that of the part of the central shaft which projects beyond the slab 29. In this case, the shaft enters into the platform at 205, which allows an even solider connection between these two units, shaft and bridge, to be made.

As is evident, the manner of realisation described has only been given by way of example and could be modified, especially by the substitution of equivalent techniques, without going beyond the scope of the present invention in the process.

We claim:

1. Offshore structure comprising in combination, a support structure for resting on the bottom of a body of water and having means for registering therewith as an integral unit another member extending upwardly in the body of water, and another member comprising a platform of at least two pieces, each of them made up of a body which is closed, water-tight, floatable on water and fixed in registration with said support structure and therewith immersed in water comprising an assembly with at least one column projecting above the surface of the water including at least one support leg fixed under the platform rigidly connected with a single platform piece.

2. Offshore structure according to claim 1, in which the platform and the support structure comprise guide means for allowing precise positioning together of pieces and connection means establishing the mechanical continuity of the structural units.

3. Offshore structure according to claim 1 in which the platform is entirely equipped with all installations ready to function before transporting the structure to said place where it has to be installed.

4. Offshore structure according to claim 1, in which there are two platform pieces, one having at least one slot wherein one other platform piece is placed.

5. Offshore structure according to claim 4, in which the slot has edges widening out in at least one sectional plane in such a way as to facilitate the entrance and positioning of the other piece.

6. Offshore structure according to claim 1, in which the platform pieces encircle at least one support member and are fastened solid with the column or support columns by means of one or two flanges.

7. Offshore structure according to claim 1, comprising a plurality of support legs fixed to the support structure.

8. Offshore structure according to claim 7, in which supports are fixed to the support structure comprising centering means for the legs.

9. Offshore structure according to claim 1 in which two platform pieces are connected by means of fixed hooks movable with flat jacks to engage a system of catches.

10. Offshore structure according to claim 1 in which the support structure has two concentric columns.

11. Offshore structure according to claim 1, in which the platform has means engaging a support structure with one column.

12. Offshore structure according to claim 1, in which the platform is affixed on a support structure with two columns by brackets.

13. Offshore structure according to claim 1, in which the platform is fixed on a support structure with three columns.

14. Offshore structure according to claim 1, in which the platform is fixed on a structure with four columns.

15. Offshore structure according to claim 1, including a support structure with two concentric columns supporting the platform and comprising a water-tight slab which closes the annular space between the two columns.

16. Offshore structure according to claim 2, having hollow legs supporting the lower face of the platform.

17. Offshore structure according to claim 2, in which the column projecting above the water expands to the bottom of the platform.

18. Offshore structure comprising in combination, a support structure for resting on the bottom of a body of water and having means for registering therewith as an integral unit another member extending upwardly in the body of water, and another member comprising a platform of at least two pieces, each of them made up of a body which is closed, water-tight, floatable on water and fixed in registration with said support structure and therewith immersed in water comprising an assembly with at least one column projecting above the surface of the water including support legs vertically displaceable and means allowing the platform to be raised while resting on the support structure by displacing said support legs.

19. Offshore structure according to claim 18, in which the vertically displaceable legs are cross-braced.

20. Method of fabrication and transporting of an offshore structure intended to be installed at sea and comprising when fabricated a support structure and a platform mounted on the said structure, in which the platform is made up of at least one floatable piece and the support structure has a portion for receiving the platform in registration therewith including the steps of floating the platform, immersing the support structure to a depth sufficient for the portion thereof intended for the reception of the platform to be situated near the level for registration with the platform, fixing the platform to the support structure to form an assembly, then making the offshore structure assembly lighter and transporting the lighter assembly to the place where it has to be installed, in which first the support structure is brought to a sufficiently low level for the platform to be able to be brought, by floating, above the support structure, the platform is hoisted up by means of movable legs to a height a little greater than the permanent height, a complementary piece of suitable height is inserted between the platform and the lowered support structure, and the platform is placed on the said piece.

21. Method according to claim 20, in which the complementary piece is connected to the support structure in a water-tight way after permanent positioning.

22. Offshore structure comprising in combination, a support structure for resting on the bottom of a body of water, a floatable platform having affixed thereto legs movable in relation thereto to relatively adjust the position between the support structure and the platform, a further member of predetermined adjustable height coupled between the support structure and said platform and connected to the support structure in a water-tight connection and having an assembly of legs fixed to the upper extremity of said support structure on which said movable legs register.

23. Offshore structure according to claim 22, in which the platform legs are movably controlled by mechanisms mounted on the platform which allow the raising of the platform relative to the support structure legs.

24. Offshore structure according to claim 22, in which the structure is placed at the bottom of a sheet of water, comprising at least one column of a height greater than the depth of the water, whose extremity is de-mountable to allow passage above the column while resting in place, and a platform in one single piece floating on the water with a draught less than the depth of the extremity of the said remaining part of the column.

25. Offshore structure according to claim 24, in which the upper extremity of the column is covered with a temporary water-tight plate.

26. Offshore structure according to claim 22, in which the fixed legs on the support structure are cross-barred or wind-braced.

27. Offshore structure according to claim 23, in which the offshore structure includes an assembly of movable cross-bars stacked at the upper end of the fixed support structure legs and capable of sliding the length of the movable legs of the platform after positioning of the platform on the support structure fixed legs.

28. Offshore structure according to claim 27, in which cross-bars are fixed to the movable legs after they have been placed at a predetermined level.

29. Offshore structure according to claim 23 having cross-bars in which a fixing arrangement between the cross-bars and the movable legs is provided for clamping the cross-bars to the legs.

30. Offshore structure according to claim 29, including a fixing mechanism between the cross-bars and the movable legs constituted by annular arrangements of wedges controlled by annular flat jacks.

31. Offshore structure according to claim 24, in which the demountable part of the column is provided with a water-tight bottom which allows it to float and to be loaded with ballast.

32. Offshore structure according to claim 22, in which the movable legs rest directly on a slab.

33. Offshore structure according to claim 32, in which the slab is surrounded by a ledge.

34. Offshore structure according to claim 32 with a flange concentric with the ledge.

35. Offshore structure according to claim 31, in which the slab is at least partially covered with a shock-absorption arrangement.

36. In a method of building, in a naval yard, an offshore structure to be stationed at an offing site away from said yard, said structure comprising a floatable support and a platform designed to be fitted to an upper portion of said support and made up of two separate and distinct pieces adapted to mate with one another and with said upper portion, at least one of said pieces being floatable, the method comprising the steps of: ballasting said support so as to immerse it to an extent sufficient for said portion thereof to be close to the level of said platform, floating at least one floatable piece into mating engagement with said portion, fitting the other of the two pieces into mating engagement with said floatable piece and with said portion, thereby establishing the integrality of said platform with respect to said support, fixing said platform to said support, unballating said support so as to upheave the support and platform assembly, and driving said assembly from said yard to said offing site.

37. Method according to claim 36 in which the floating platform includes legs that are hollow and can be ballasted and deballasted at will and further comprising the step of ballasting the platform when vertically above the support structure until the point at which the platform rests on the support.

* * * * *